US005608501A

United States Patent [19]

Makino

[11] Patent Number: 5,608,501

[45] Date of Patent: Mar. 4, 1997

[54] DEVELOPMENT UNIT AND TONER CARTRIDGE FOR USE IN AN IMAGE FORMATION APPARATUS

[75] Inventor: Kazumasa Makino, Nagoya, Japan

[73] Assignee: Brother Kogyo Kabushiki Kaisha, Nagoya, Japan

[21] Appl. No.: 365,773

[22] Filed: Dec. 29, 1994

[30] Foreign Application Priority Data

Feb. 16, 1994 [JP] Japan ..... 6-019227

[51] Int. Cl.[6] ..... G03G 15/06

[52] U.S. Cl. ..... 399/119; 399/103

[58] Field of Search ..... 355/260, 245; 118/653; 222/DIG. 1, 557, 560

[56] References Cited

U.S. PATENT DOCUMENTS

| | | | |
|---|---|---|---|
| 4,026,241 | 5/1977 | Takebe et al. . | |
| 4,460,267 | 7/1984 | Ogawa . | |
| 4,615,364 | 10/1986 | Kawata | 222/DIG. 1 |
| 4,937,628 | 6/1990 | Cipolla et al. | 355/260 |
| 5,078,303 | 1/1992 | Kikuchi et al. | 222/DIG. 1 |
| 5,089,854 | 2/1992 | Kaieda et al. | 355/260 |
| 5,091,750 | 2/1992 | Yoshida | 355/260 |
| 5,419,468 | 5/1995 | Taki | 222/DIG. 1 X |
| 5,506,665 | 4/1996 | Ishida et al. | 355/260 |

FOREIGN PATENT DOCUMENTS

| | | | |
|---|---|---|---|
| 0225745A1 | 6/1987 | European Pat. Off. . | |
| 0385865A3 | 9/1990 | European Pat. Off. . | |
| 0435259A3 | 7/1991 | European Pat. Off. . | |
| 483440 | 5/1992 | European Pat. Off. | 355/260 |
| 0661608A2 | 7/1995 | European Pat. Off. . | |
| 0682297A2 | 11/1995 | European Pat. Off. . | |
| 3323086A1 | 12/1983 | Germany . | |
| 61-53677 | 3/1986 | Japan . | |
| 63-179377 | 7/1988 | Japan . | |
| 01296261 | 11/1989 | Japan . | |
| 04350870 | 12/1992 | Japan . | |

OTHER PUBLICATIONS

Patent Abstracts of Japan vol. 014 No. 088 (P–1008), 19 Feb. 1990, English–language abstract of JP–A–01 298382 (Matsushita Electric Ind Co Ltd).

Patent Abstracts Of Japan vol. 012 No. 214 (P–718), 18 Jun. 1988, English–language abstract of JP–A–63 011975 (Minolta Camera Co Ltd).

*Primary Examiner*—Robert Beatty

*Attorney, Agent, or Firm*—Oliff & Berridge

[57] ABSTRACT

A development unit for use in an image formation apparatus is provided with a mechanism that allows a toner box to be removably attached to a case of the development unit. The mechanism includes a concave first shutter that closes a toner exhaust port formed in the toner box and a second convex shutter that closes a toner introduction port formed in an agitation chamber. The first and second shutter interlock with each other. Arms are provided on bosses formed along the outer circumference of support grooves in a pair of brackets in the case. The second shutter is attached to the arms, and the first shutter is provided between levers that pivot on the support shaft of the toner box. When the levers are pivoted while the support shaft is fitted into the support grooves, engagement projections formed on the levers are positioned in insertion grooves formed in the arms. The arms are then pivotally moved, so that the first and second shutters pivot while overlapping each other. As a result of this, unnecessary leakage of toner is prevented.

41 Claims, 9 Drawing Sheets

DEVELOPMENT UNIT AND TONER CARTRIDGE FOR USE IN AN IMAGE FORMATION APPARATUS

BACKGROUND OF THE INVENTION

1. Field of the Invention

The present invention relates to the structure of a development unit for use in an image formation apparatus such as a laser printer, a copier or a facsimile apparatus.

2. Description of the Related Art

Conventionally, a dry developing apparatus, such as disclosed in Japanese Examined Patent Publication No. Hei 4-48232, accomplishes development by supplying developer to a development area on the surface of a photoreceptor drum. According to the disclosed structure of this developing apparatus, a development sleeve is provided in a development case disposed adjacent to the photoreceptor drum. The bore of the development sleeve is provided with a magnetic roller, and a mixture (developer) consisting of toner and magnetic carriers is carried over the outer periphery of the development sleeve. A slit for supplying toner is formed in a partition wall between the development case and a toner supply chamber having a toner agitation member, whereby the case and the chamber communicate with each other through this slit. The agitation member for supplying toner to the inside of the development case is provided in the toner supply chamber, and a lid is provided in a drawable manner in an upper opening formed in the toner supply chamber.

On the other hand, a cartridge lid is provided in a lower opening formed in a toner cartridge, which stores toner for supply purposes, in such a way that it is located at the outside of the lid. The toner cartridge and the toner supply chamber communicate with each other by drawing the lid and the cartridge lid in an integrated fashion while the toner cartridge is attached to the upper opening of the toner supply chamber.

In Japanese Examined Patent Publication No. Hei 4-48232, both the lid of the toner supply chamber and the cartridge chamber of the toner cartridge are fitted in such a way that they are linearly movable in a slidable fashion in the direction orthogonal to the paper as seen in FIG. 1 of that publication, along recessed rails provided on both sides of each of the openings. According to this construction, there are two possible ways to supply toner to the toner supply chamber.

One way is to draw the lid and the cartridge lid in an integrated fashion while the toner cartridge is attached to the toner supply chamber at the first supply of toner, so that both lids are discarded. The attached empty cartridge is held to close the upper opening of the toner supply chamber until the subsequent supply of toner is available. When the subsequent supply of toner is provided, the empty toner cartridge is replaced with a new cartridge, and the new cartridge is attached to the upper opening of the toner supply chamber.

According to this method, it is necessary for the image formation apparatus to be provided with space for holding an empty toner cartridge. This space is so-called "dead space".

Moreover, both the lid and the cartridge lid are discarded. Hence, the upper opening of the toner supply chamber and the lower opening of the empty toner cartridge are temporarily uncovered. Therefore, when the empty toner cartridge is removed, toner housed in both the toner supply chamber and the toner cartridge splashes out, which contaminates the area surrounding the openings.

Another way of supplying toner is to draw the lid and the cartridge lid in an integrated fashion when supplying toner while the toner cartridge is attached to the toner supply chamber. Once the toner contained in the toner cartridge is supplied to the toner supply chamber, the lid and the cartridge lid are returned to their original positions, and each of the openings is closed. In this state, the toner cartridge is removed from the supply chamber together with the cartridge lid.

In this case, the cartridge lid and the lid project in one lateral direction of the supply chamber and the toner cartridge. Toner is attached to each side surface of the cartridge lid and the lid. Hence, even in this case, toner splashes out in the area in the vicinity of the lateral surface. In addition to the cartridge lid and the lid, which both project in an obstructive manner, fingers and clothes of a worker will be soiled by toner, which makes it difficult and unpleasant for the worker to carry out toner supply work.

SUMMARY OF THE INVENTION

This invention is made to solve the above technical problems and to provide a developing apparatus for use in an image formation apparatus that facilitates toner supply work and prevents soiling caused by toner.

To this end, according to a first aspect of this invention, there is provided a development unit for use in an image formation apparatus having a photoreceptor unit, a development unit provided adjacent to the photoreceptor unit, and a toner box removably attached to a case of the development unit. The apparatus comprises a first shielding member for closing a toner introduction port formed in the case of the development unit, and a second shielding member for closing a toner exhaust port formed in the toner box while the toner box is being attached to the case. The development unit comprises a mechanism that allows the toner box to be removably attached to an attachment portion of the case of the development unit in such a way that the toner exhaust port of the toner box is opposed to the toner introduction port of the case. This arrangement causes the first shielding member to be movably attached to the attachment portion of the case. This also causes the first shielding member to be linked and interlocked with the second shielding member in such a way that the first shielding member opens and closes the toner introduction port when the second shielding member is opened and closed.

In a preferred mode, the first shielding member for closing the toner introduction port formed in the case is pivotable along the outer surface of the case. The second shielding member for closing the toner exhaust port formed in the toner box is pivotable along the outer surface of the toner box.

DETAILED DESCRIPTION OF PREFERRED EMBODIMENTS

Referring to the accompanying drawings, an example that embodies the present invention is described below.

Figure 1:
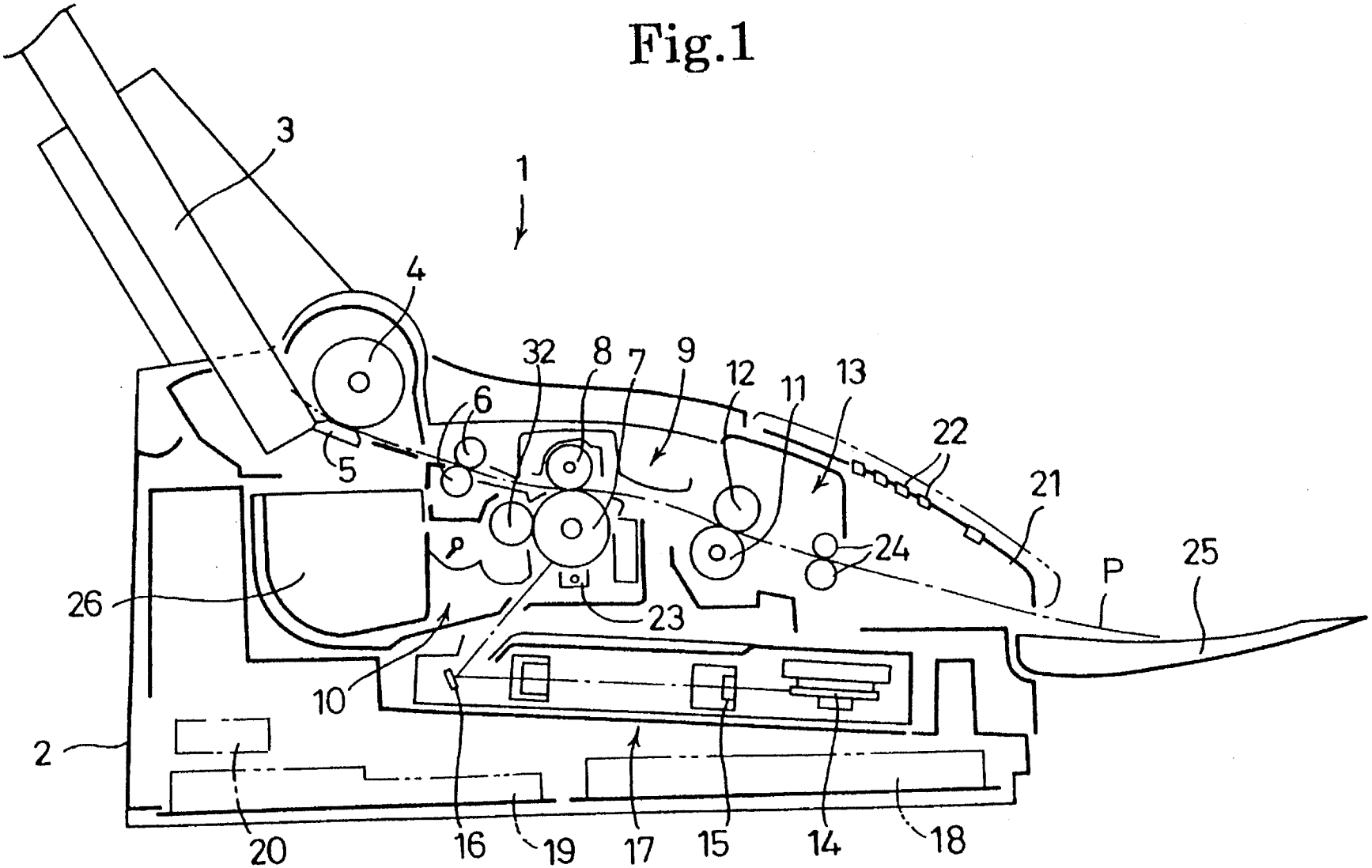
FIG. 1 is a schematic side cross-sectional view showing a laser printer according to one embodiment of the present invention.
Figure 2:
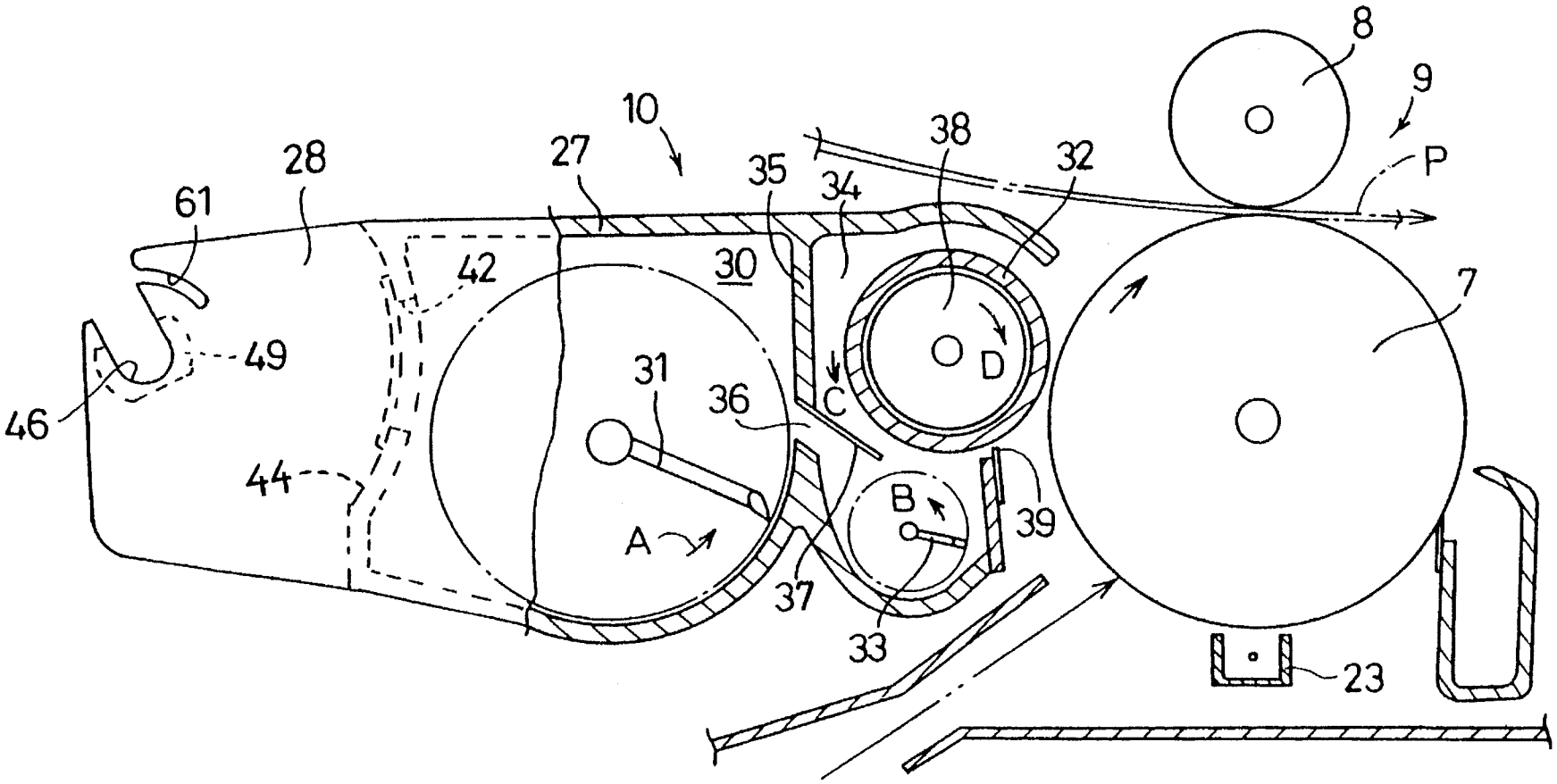
FIG. 2 is a side view in partial section showing the principal elements of a case of a developing apparatus according to one embodiment of the present invention.

FIG. 1 is a schematic side cross-sectional view showing an image formation apparatus in the form of a printer 1. FIG. 2 is a partially broken cross-sectional view showing a development unit 10 in the printer 1.

In the printer 1 according to this embodiment, a paper feed cassette 3 is removably attached to one upper side of a main body case 2. Paper P, which serves as a recording medium, is stacked in the paper feed cassette 3 and is separated sheet by sheet and transmitted via conveyor rollers 6 to a photoreceptor unit 9, which may include a photoreceptor drum 7 and a transfer roller 8. The development unit 10, which will be described later, is positioned adjacent to the photoreceptor unit 9 on the side thereof close to the paper feed cassette 3. A fixing unit 13, consisting of a heating roller 11 and a pressing roller 12, is positioned downstream from the photoreceptor unit 9.

Control boards 18 and 19, a power unit 20, a scanner unit 17 comprising a laser beam emission section 14, a lens 15 and a reflection mirror 16 are provided below the photoreceptor unit 9. A number of operation buttons 22 are provided on a cover body 21.

The surface of the photoreceptor drum 7, which is previously charged by a charger 23, is exposed to light emitted from the scanner unit 17 in response to image data transmitted from external equipment such as a non-illustrated host computer, so that an electrostatic latent image is formed on the surface of the photoreceptor drum 7. Then, processing is carried out in which the latent image is visualized in the form of an image by supplying magnetized powdered toner as a result of the rotation of a development sleeve 32 of the development unit 10 in the direction of an arrow A. Thereafter, the toner image is transferred to paper P supplied between the photoreceptor drum 7 and the transfer roller 8. The transferred image is then heated and pressurized by the fixing unit 13, whereby the toner image is fixed to the paper P. The paper P is then discharged from a pair of paper discharge rollers 24 to a copy receiving tray 25 of the printer 1.

Referring to FIGS. 2–8, the development unit 10, which is a chief element of the embodiment according to this invention, is described. As shown in FIG. 2, a case 27 made of synthetic resin of the development unit 10, is divided into an agitation chamber 30 and a developing chamber 34 via a partition wall 35, which serves as a partition member. An opening 36 is formed in the partition wall 35 in such a way that it is opposed to one circumferential side of the development sleeve 32.

Figure 3:
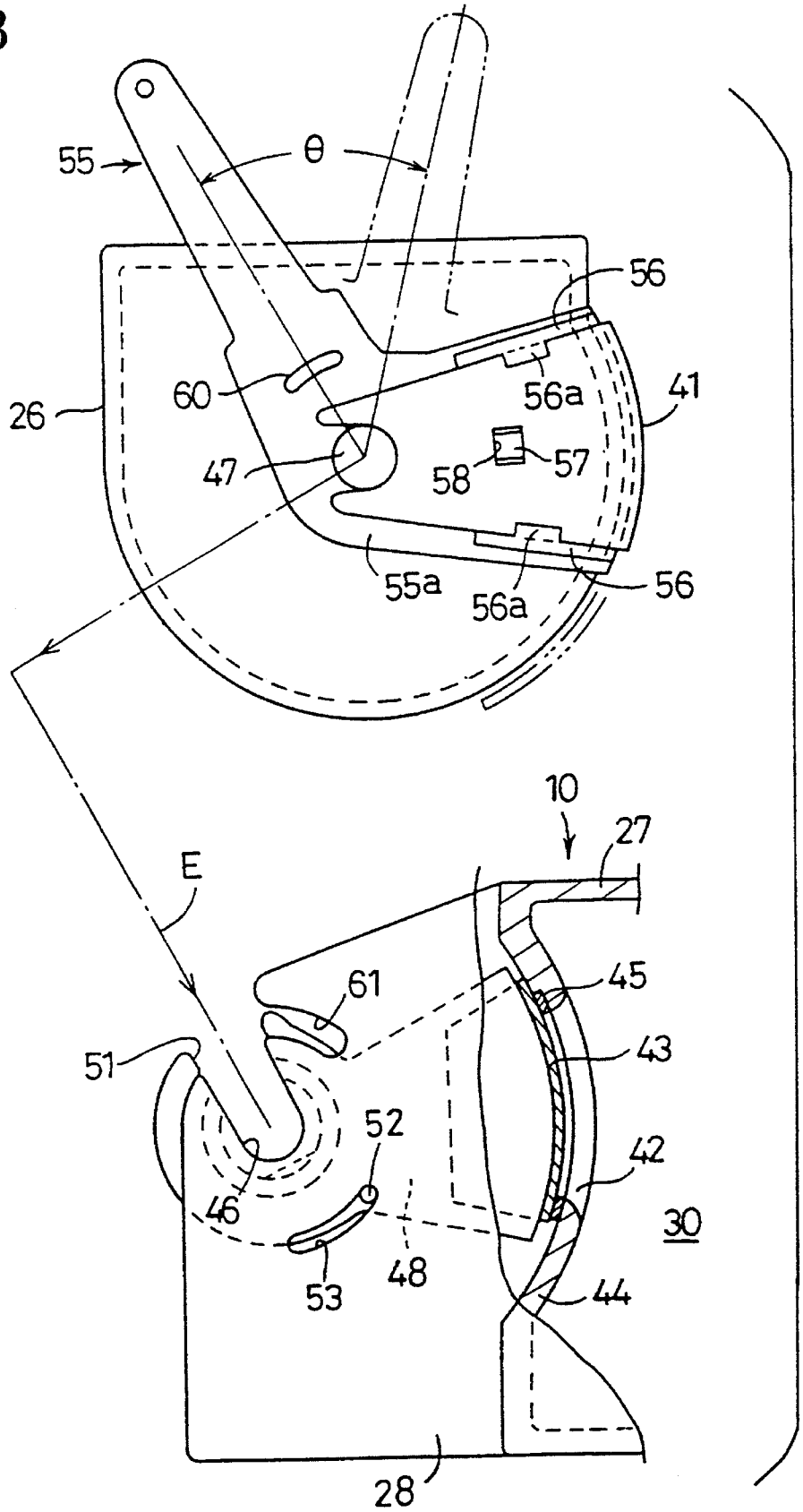
FIG. 3 is an exploded side view in partial section showing a direction in which a toner box is attached to the case of the developing apparatus.

A toner box 26 (see FIG. 3) for supplying non-magnetic toner or magnetic toner to the agitation chamber 30 is attached in a removable fashion, which will be described later, to a pair of brackets 28 (only one bracket 28 is shown in FIGS. 2 and 3) projecting from the right and left sides of the case 27. The supplied toner is stirred by an agitation member 31 consisting of a moving vane provided in the agitation chamber 30.

The development sleeve 32 in the bore of which a magnetic roller 38 is provided and an agitation member 33 are disposed in the developing chamber 34. One side of the circumferential surface of the rotatable development sleeve 32 is opposed to the outer circumferential surface of the photoreceptor drum 7.

A regulation member 37 includes of a film having an elasticity such as a magnetic permeable PET (polyethylene terephthalate) is attached to the vicinity of the opening 36. The middle of the regulation member 37 downwardly stretches within the developing chamber 34 and is opposed to the outer circumferential surface of the developing sleeve 32. Moreover, the free end of the regulation member 37 is arranged to be adjacent to the outside of a rotating locus of the agitation member 33.

As shown in FIG. 2, the agitation member 31 rotates in the direction of the arrow A, so that toner in the agitation chamber 30 is scraped up from the bottom toward the opening 36. The agitation member 33 is rotated in the direction of an arrow B to stir the toner supplied from the opening 36 and magnetic carriers previously stored in the developing chamber 34. The toner and the magnetic carriers are splashed toward an under surface of the development sleeve 32 via the bottom of the developing chamber 34. The development sleeve 32 rotates in the direction of an arrow C, whilst the magnetic roller 38 (north poles and south poles being alternately arranged) housed in the bore of the sleeve rotates in the direction of an arrow D.

In the developing chamber 34, a trimmer blade 39 is provided at the position near to one side of the circumferential surface of the photoreceptor drum 7 for adjusting the thickness of a layer of toner (the thickness of a layer of a developer) carried on the outer surface of the development sleeve 32 by the magnetic carriers.

The development method used in this embodiment may be either a so-called two-component development method comprising 95–98% magnetic carriers (a weight ratio) and 2–5% non-magnetic toner (a weight ratio) or a so-called one and a half component development method comprising 30–80% magnetic carriers (a weight ratio) and 20–70% magnetic toner (a weight ratio).

FIGS. 3–7 show a mechanism that allows the removable attachment of the toner box 26 to the development unit 10. Basically, a first shutter 41, which serves as a first shielding member, closes a toner exhaust port 40 of the toner box 26. The first shutter 41 is linked with a second shutter 43, which serves as a second shielding member, and closes a toner introduction port 42 of the agitation chamber 30.

Figure 6A:
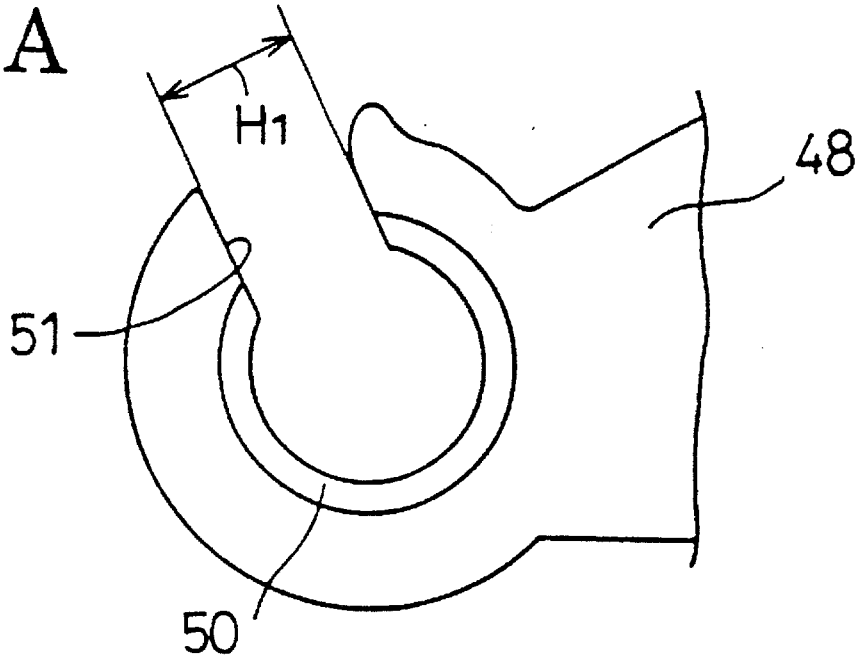
FIG. 6A is a partial side view showing an arm attachment section of the case for a second shutter.
Figure 6B:
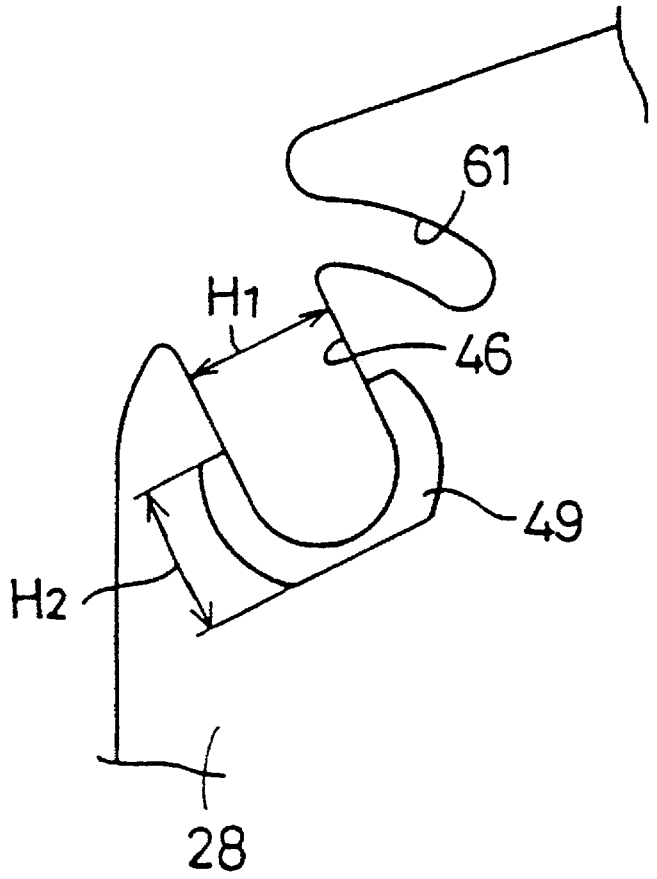
FIG. 6B is a partial side view showing a bracket for supporting the toner box.

In the case 27, a circular-arc-like partition wall 44 is provided on one side of the agitation chamber 30 (the side opposite to the partition wall 35). The substantially rectangular toner introduction port 42, which extends longitudinally in the direction orthogonal to the paper as viewed in FIGS. 2 and 3, is opened in the partition wall 44. A sealing material 45 including a felt material is stretched over the area surrounding the toner introduction port 42. A pair of brackets 28 are provided in such a way that the toner introduction port 42 is longitudinally sandwiched between them. As shown in FIG. 6B, a U-shaped support groove 46 having a width H1 with an open upper end is formed in each bracket 28. The support groove 46 is upwardly tilted in such a way as to be spaced apart and facing away from the partition wall 44 as seen in FIG. 2.

Figure 4:
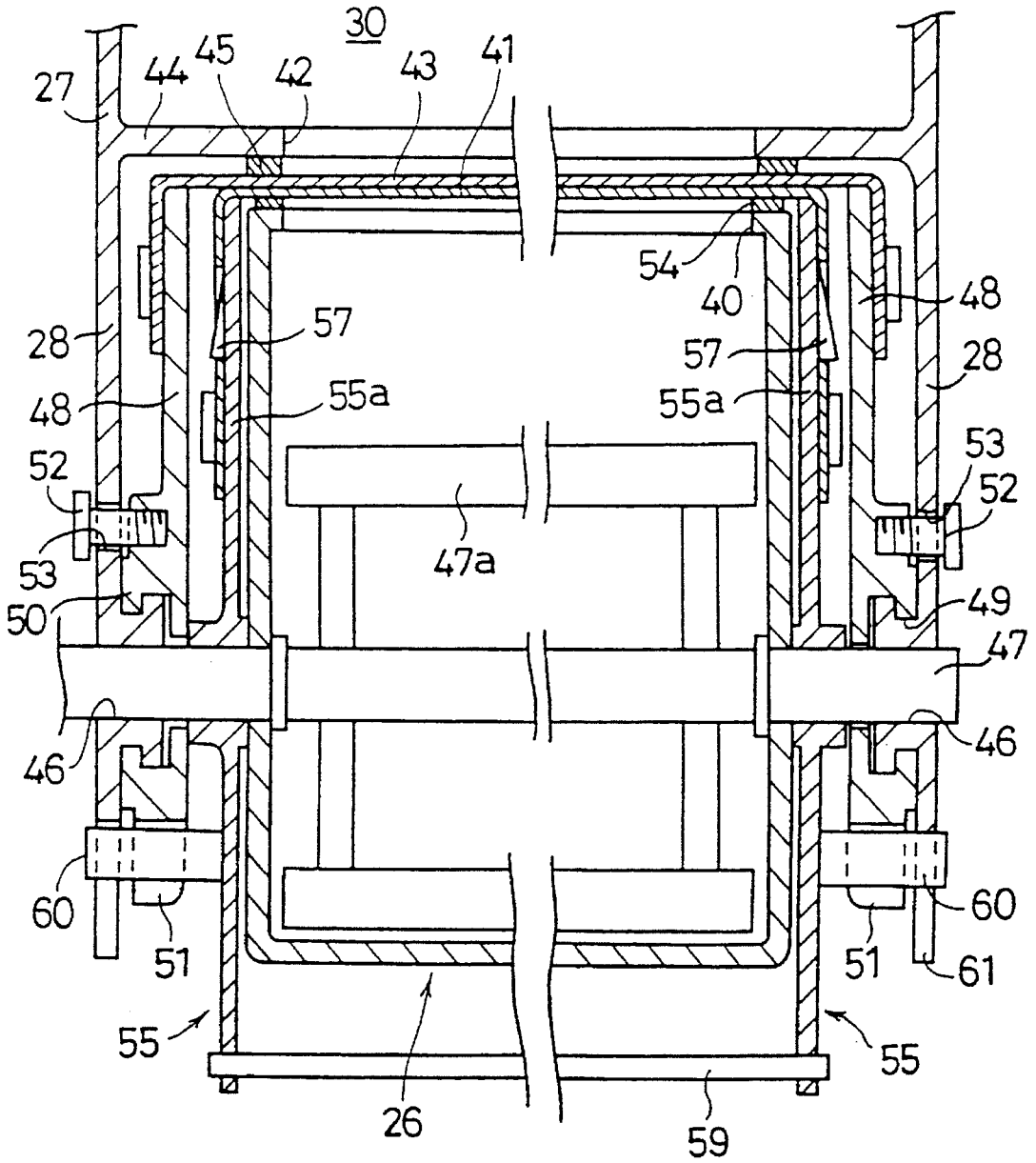
FIG. 4 is a partial cross-sectional view showing the laser printer when the toner box is attached to the laser printer.
Figure 5:
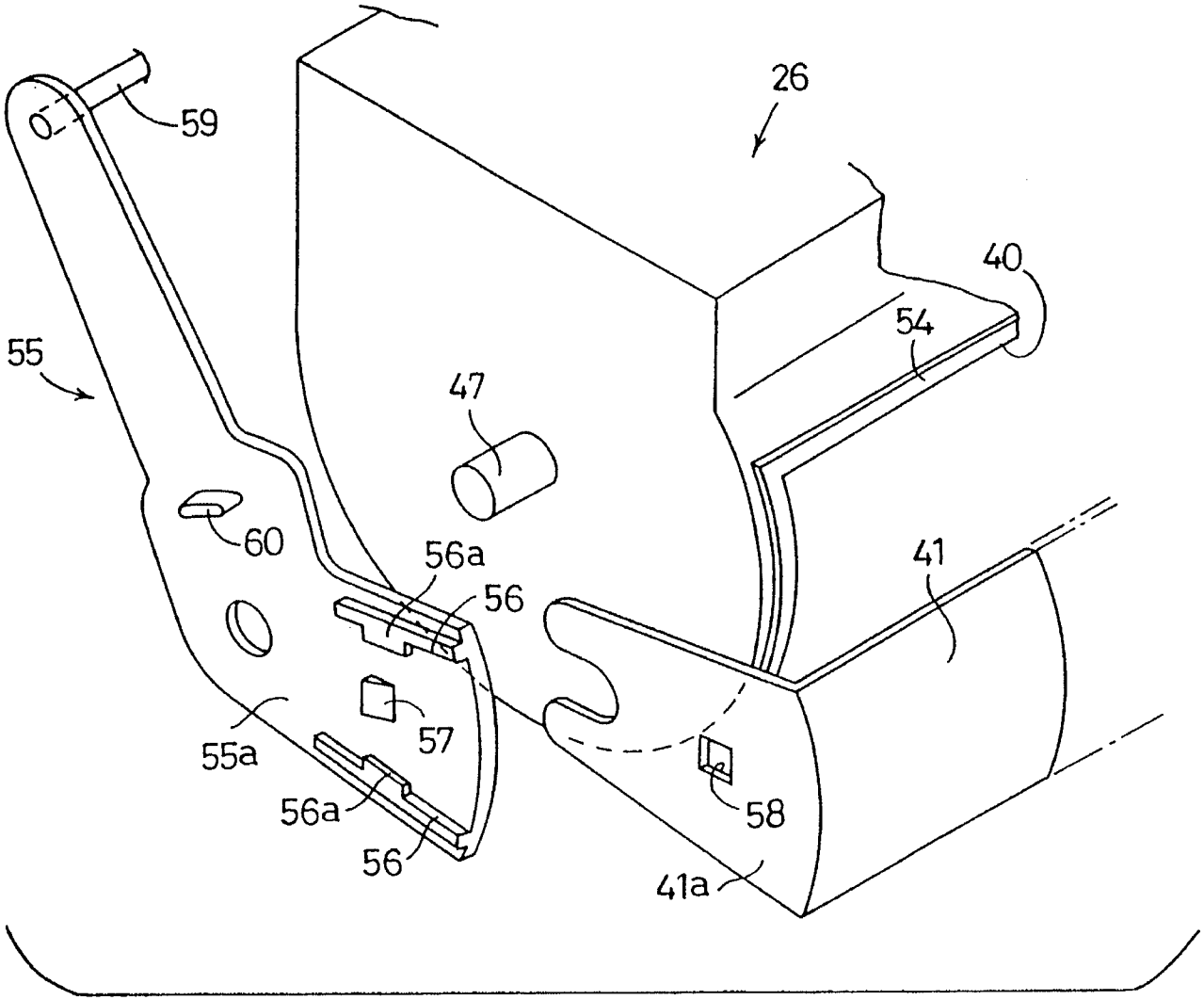
FIG. 5 is a partial perspective view showing the toner box.

As seen in FIGS. 3, 4 and 5, support shaft 47 horizontally projects from both ends of the toner box 26 can be removably inserted into these support grooves 46 in the direction of an arrow E shown in FIG. 3. Also, the support shaft 47 is rotatably supported by the circular arc bottom of the support groove 46. Toner stored in the toner box 26 can be delivered to the agitation chamber 30 of the development unit 10 by rotating vanes 47*a* (see FIG. 4) attached to the support shaft 47 via a non-illustrated drive mechanism.

As shown in FIG. 3, the second shutter 43 for closing the toner introduction port 42 is made of a thin metal plate, such as aluminum, having an arcuate cross section. Both ends of the second shutter 43 are supported by substantially fan-shaped arms 48. As shown in FIG. 4, a shaft support section 50 is formed on each arm 48 and is rotatably fitted to a boss 49 formed around the outer periphery of the support groove 46 of each bracket 28. As shown in FIG. 6A, an insertion groove 51 having the same width H1 as that of the support groove 46 is formed in the shaft support section 50.

As seen in FIG. 6B, dimension H2 of the boss 49 in the direction that intersects the direction of extension of the support groove 46 is set to be equal to the width H1 of the insertion groove 51. The arm 48 fits into the boss 49 from the open side of the insertion groove 51 along the direction of a narrow width of the boss. Then, the arm 48 is rotated in the direction in which the toner introduction port 42 is closed by the second shutter 43, so that it becomes impossible for the shaft support section 50 to be disengaged from the boss 49. As seen in FIG. 3, regulation pins 52, which project from the outer surface of both arms 48 and serve as regulating members, fit into circular arc guide grooves 53 drilled in the bracket 28 and regulate the range of the rotation of the arms 48.

Figure 7A:
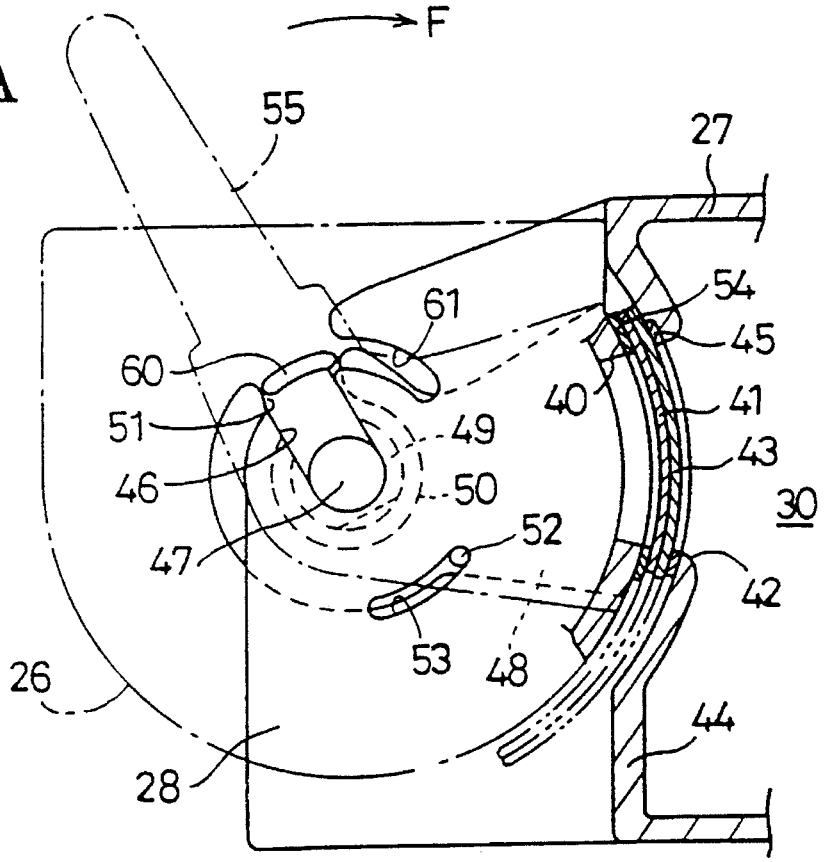
FIG. 7A is a side cross-sectional view showing the toner box when a shutter is closed.

As shown in FIG. 7A, at least the exterior surface of the toner box 26 opposed to the arcuately shaped partition wall 44 of the case 27 is shaped into an arcuate surface that is concentric with the partition wall 44. The toner exhaust port 40 having substantially the same shape as the toner introduction port 42 is opened in the exterior surface of the toner box, and a sealing material 54 including felt material or the like is stretched over the outer periphery of this toner exhaust port 40.

Figure 8:
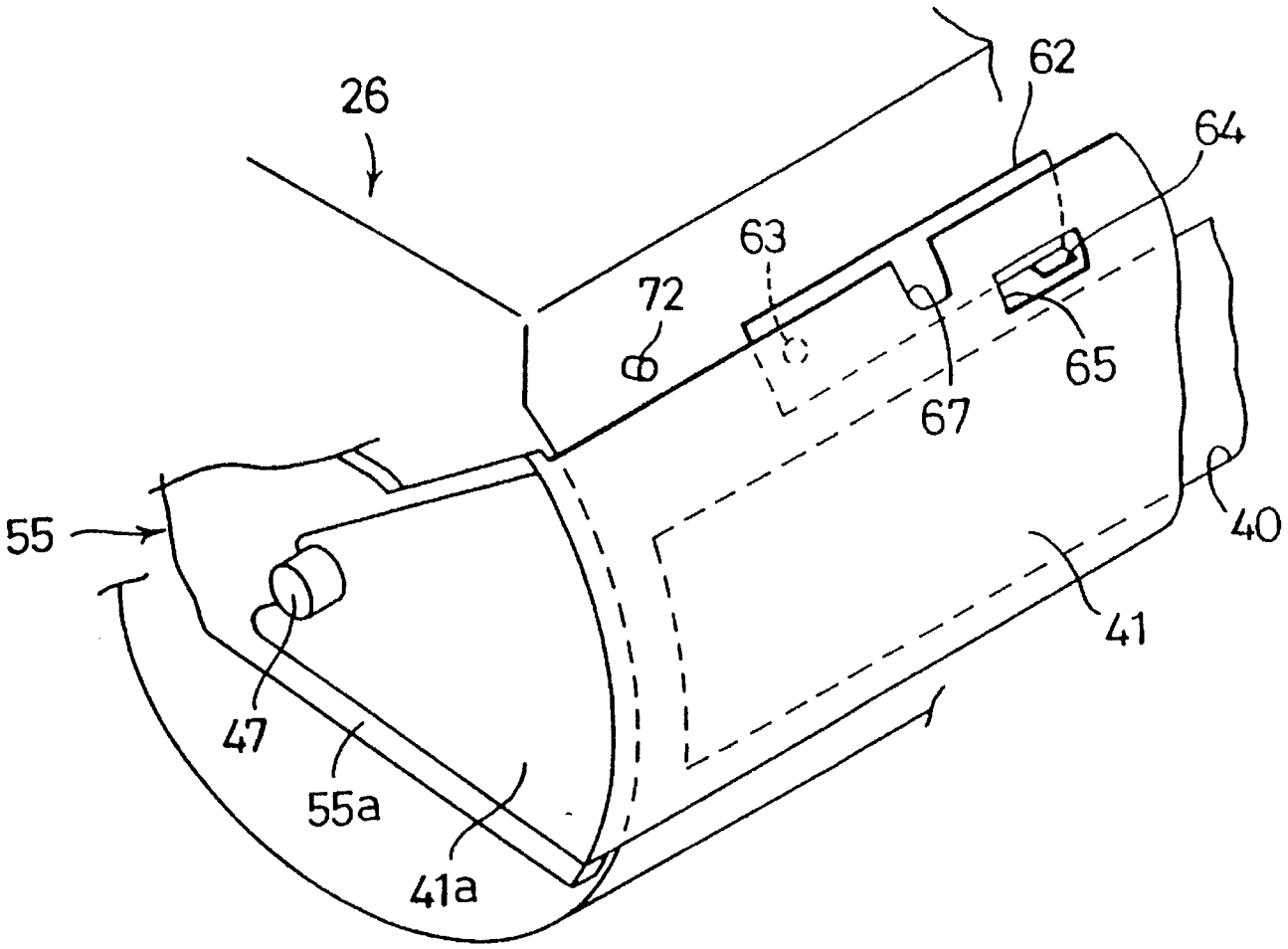
FIG. 8 is a partial perspective view showing a first lock mechanism of a first shutter provided on a toner box side.

As shown in FIG. 5, the first shutter 41 for closing the toner exhaust port 40 is made of a metal plate (made from aluminum or the like), which is as thin as the second shutter 43 and is shaped to have an arcuate cross section. A pair of levers 55 are rotatably fit onto the support shaft 47 of the toner box 26. The pair of levers 55 are linked to a link rod 59 so that they rotate in an integrated fashion. Both ends 41*a* of the first shutter 41 are removably attached to the outer surfaces of substrates 55*a* of the levers 55. In operation, both edges of the fan-shaped end 41 are inserted along a pair of guide grooves 56 and 56 provided on the exterior surface of the substrate 55*a* in such a way that the edges fit into the guide grooves 56. The edges of the end 41*a* are held at the locations of a projection 56*a* that acts as a slip-off prevention member in each guide groove 56. A wedge-shaped stop claw 57, formed on the exterior surface of the substrate 55*a* as an engagement member, engages in a fitting manner with a stop hole 58, which is opened at a certain point within a surface of the end 41*a* that flares outwardly. As shown in FIG. 8, both ends 41*a* of the first shutter 41 may also be adhered and fixed to the exterior surface 55*a* of the lever 55.

When the toner box 26 is inserted such that the support shaft 47 of the toner box 26 moves into the support groove 46, an engagement projection 60 shown in FIG. 5, which projects from the exterior surface of the substrate 55*a* of each lever 55 and acts as an engaged member, is positioned outside the radius of the support groove 46 as seen in FIG. 7A. At the same time, the engagement projection 60 is located in the insertion groove 51 of the attachment arm 48 (see FIG. 7A). An arcuate slip-off prevention guide groove 61, which is concentric with the support shaft 47 that rotates at the bottom of the support groove 46, is opened in the bracket 28 in such a way that the side of the guide groove 61, which is farther away from the toner introduction port 42 of the agitation chamber 30, communicates with the support groove 46. The engagement projection 60, which moves in accordance with a predetermined rotation angle θ of the lever 55 as shown in FIG. 3, fits into the slip-off prevention guide groove 61, whereby the toner box 26 cannot be disengaged from the bracket 28 even when the lever 55 is pulled (see FIG. 7B).

Figure 9:
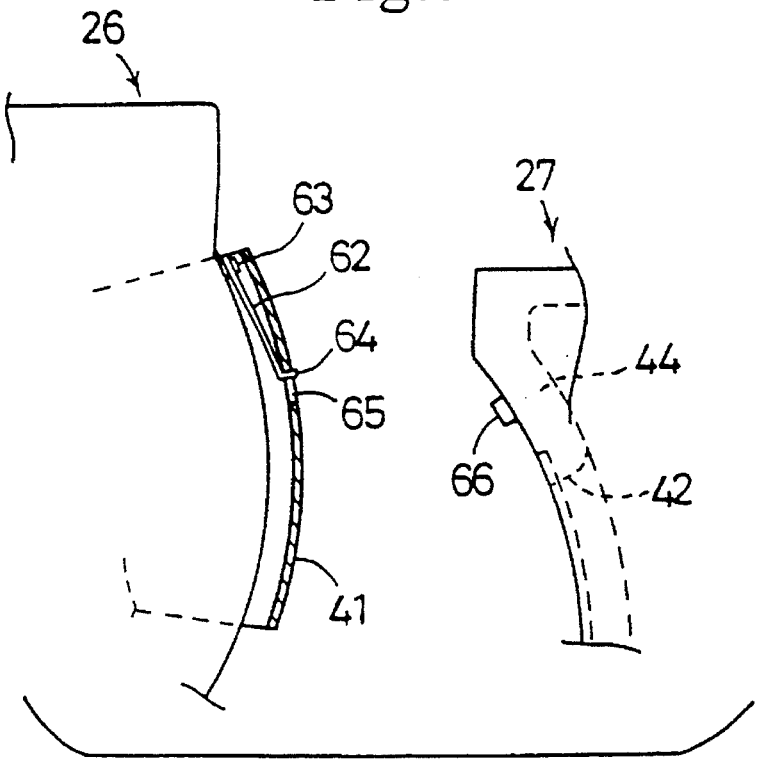
FIG. 9 is a side cross-sectional view showing a lock releasing action of the first shutter.
Figure 10:
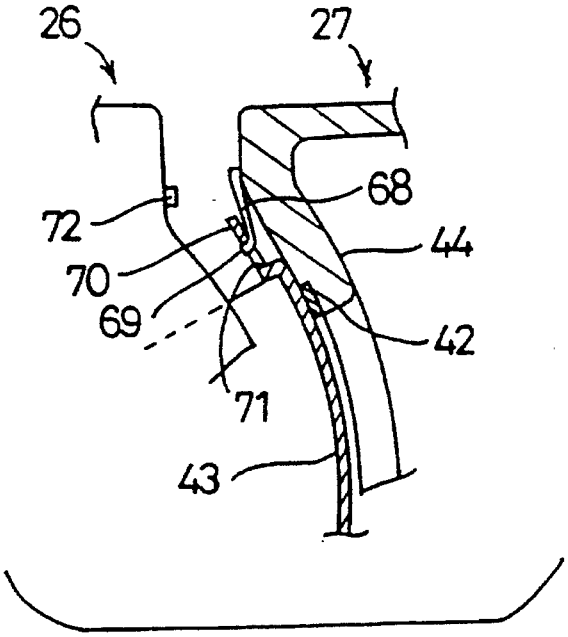
FIG. 10 is a side cross-sectional view showing a lock releasing action of the second shutter provided on a case side.

Referring to FIGS. 8–10, lock mechanisms of both shutters 41 and 43 of the toner box 26 are described.

While being disengaged from the pair of brackets 28 or the development unit 10, the toner box 26 is locked by a lock mechanism so that the toner exhaust port 40 and the toner introduction port 42 will not be opened when the first shutter 41 of the toner box 26 and the second shutter 43 of the agitation chamber 30 are respectively rotated inadvertently. In addition, the lock mechanisms are released from their locked state while the support shaft 47 of the toner box 26 is attached to the support grooves 46 of the pair of brackets 28.

The first lock mechanism of the first shutter 41 is constructed as shown in FIGS. 8 and 9. A lock body 62 made of a leaf spring is inserted into a gap between one outer side surface of the toner box 26 and the inner surface of the first shutter 41. One end of this lock body 62 is fixed to the outer side surface of the toner box 26 with a screw 63. An engagement claw 64, which is formed to project outwardly by folding the other end of the lock body 62, is pressed by a resilient force of the lock body 62 itself, in such a way that the claw 64 faces an engagement hole 65 drilled in the first shutter 41. Moreover, as shown in FIG. 8, a U-shaped notched groove 67 is formed along the upper edge of the first shutter 41. A press pin 66, for pressing a surface of the lock body 62 against the outer side surface of the toner box 26, projects from the area opposed to the notched groove 67 in the outer surface (the surface opposed to the first shutter 41) of the case 27 of the development unit 10.

By means of this construction, when the support shaft 47 of the toner box 26 is inserted into the support grooves 46 of a pair of brackets 28 in other words, when the first shutter 41 and the second shutter 43 come close to each other and substantially overlap, the press pin 66 presses the surface of the lock body 62, so that the engagement claw 64 is disengaged from the engagement hole 65. At this time, the press pin 66 passes along the notched groove 67 formed along the upper edge of the first shutter 41.

The second lock mechanism of the second shutter 43 has a construction essentially the same as the first lock mechanism and includes a lock body 68 and a press pin 72. However, the relationship between the location where the lock body 68 is attached and the location where the press pin 72 is formed, is the reverse of that of the first lock mechanism. Specifically, as shown in FIG. 10, the lock body 68 made of a leaf spring is inserted into a gap between the outer surface of the case 27 and the second shutter 43. One end of this lock body 68 is fixed to one outer side surface of the case 27 with a screw (not shown). An engagement claw 69, which is formed to project outwardly by folding the other end of the lock body 68, is pressed by an elastic force of the lock body 68 itself so that the claw 69 faces an engagement hole 71 drilled in a folded section 70 formed along the upper edge of the second shutter 43. On the other hand, a press pin 72 for pressing a surface of the lock body 68 against an outer side surface of the case 27 projects from the area opposed to the lock body 68 in the outer surface (the surface opposed to the second shutter 43) of the toner box 26. In the same manner as previously mentioned, when one side surface of the toner box 62 and one side surface of the case 27 come close to each other and overlap, the press pin 72 presses the surface of the lock body 68, and the engagement claw 69 disengages from the engagement hole 71.

The attachment and removal of the toner box 26 with respect to the case 27 of the development unit 10 in the printer 1 constructed in the manner described above is detailed below.

As shown in FIG. 3, the toner box 26 in the state in which the toner exhaust port 40 is closed by the first shutter 41 is brought close to the brackets 28 of the case 27 in the direction of the arrow E. The first shutter 41 is in a locked state. The support shaft 47 is fit into the support grooves 46 such that the shaft 47 moves along the grooves 46. While this support shaft 47 comes into contact with the bottoms of the support grooves 46, the first shutter 41 and the second shutter 43 overlap each other. Moreover, as previously mentioned, the engagement claw 64 of the lock body 62 is disengaged from the engagement hole 65 of the first shutter 41 by the press pin 66. The engagement claw 69 of the lock body 68 is also disengaged from the engagement hole 71 of the second shutter 43 by the press pin 72. Hence, both shutters 41 and 43 become rotatable.

Figure 7B:
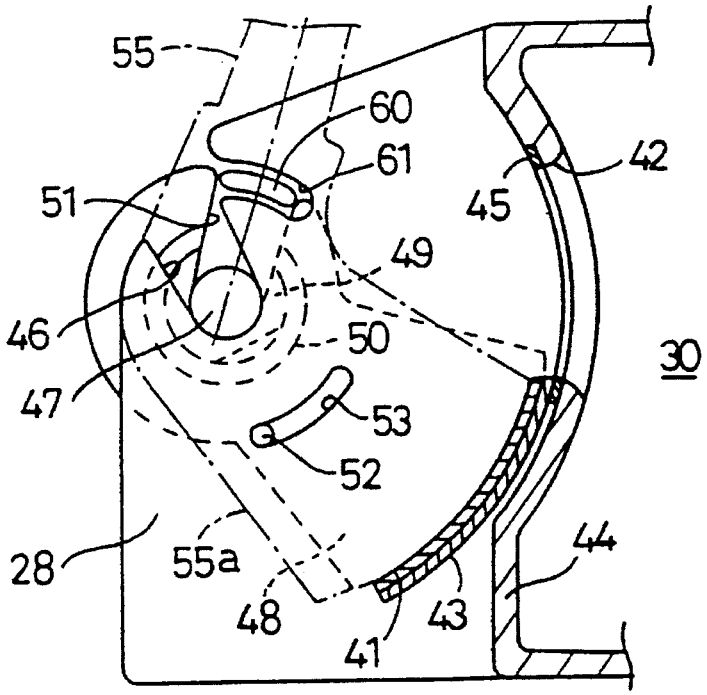
FIG. 7B is a side cross-sectional view showing the toner box when the shutter is opened.

In this state, as can be comprehended from FIGS. 7A, 7B, and 4 the descriptions of the construction, a pair of arms 48 positioned inside the brackets 28 are linked and interlocked with each other via the engagement of the engagement projections 60 and the insertion grooves 51 as a result of the rotation of the pair of levers 55, provided on the inner side of the arms 48, in such a way that the arms 48 rotate in an integrated fashion.

When the levers 55 are positioned at a location designated by a dash-and-dot line shown in FIG. 7A, the toner exhaust port 40 and the toner introduction port 42 can be respectively held in a closed state by the shutters 41 and 43. As seen, the first shutter 41 of the toner box 26 and the second shutter 43 of the agitation chamber 30 overlap each other and are in phase with each other. When the levers 55 are turned in the direction of an arrow F to a position designated by a dash-and-dot line as shown in FIG. 7B, the toner exhaust port 40 and the toner introduction port 42 can be opened while the first shutter 41 and the second shutter 43 overlap each other. Moreover, in this state, the engagement projections 60 engage with the slip-off prevention guide grooves 61, and hence the support shaft 47 can be moved to the open side of the support grooves 46. Therefore, it is possible to prevent an operator from erroneously removing the toner box 26 from the brackets 28.

In this way, the toner box 26 is attached to the case 27 of the development unit 10, and toner stored in the toner box 26 is introduced to the agitation chamber 30 by rotating the vanes **47*a* provided on the support shaft 47 after both shutters 41 and 43 have been opened by turning the lever 55**.

As a result of the returning of the lever 55 in the direction opposite to the arrow F to the position designated by the dash-and-dot line shown in FIG. 7A, the first shutter 41 closes the toner exhaust port 40 of the toner box 26, and the second shutter 43 closes the toner introduction port 42 of the agitation chamber 30. In this state, the engagement projections 60 are positioned on the open side of the support grooves 46. Hence, the support shaft 47 of the toner box 26 can be immediately removed from the support grooves 46. As a result of the separation of the toner box 26 from the case 27, the first shutter 41 and the second shutter 43 can be maintained in a locked state (that is, an unopenable state) by means of the lock bodies 62 and 68. Accordingly, it is also possible to prevent toner from inadvertently splashing or leaking out of the toner box 26 and the agitation chamber 30.

To supply toner, the toner box 26 is temporarily attached to the development unit 10. However, after the supply of toner has been completed, this toner box 26 is detached from the development unit 10. Thus, compared with a conventional case in which the toner box 26 is covered with a cover body of the printer 1 while being attached to the development unit 10 and operations such as image formation are carried out, the size of the printer 1 can be reduced. Hence, it is possible to provide a compact printer.

Moreover, at the time of the supply of toner, the first shutter 41 is stopped at the area along the outer surface of the toner box 26, and the second shutter 43 is stopped at the area along the outer surface of the case 27. In other words, both shutters 41 and 43 are located in the gap between the toner box 26 and the case 27, and hence the shutters 41 and 43 will neither outwardly project nor be bulky when the shutters are opened. It is thus possible to prevent toner attached to the inner surfaces of the shutters 41 and 43 from becoming attached to the hands and clothes of a worker.

Needless to say, the outer surfaces of the toner box 26 and the case 27, which are opposed to each other, may be made planar in shape. Then, a planar first shutter 41 and a planar second shutter 43 would be moved parallel in an interlocking manner. In this case, all that is required is an interlocking mechanism (consisting of a rotating link, a liner groove or the like) that converts a pivotal motion of the levers 55, which pivot around the support shaft 47, into a linear motion of the shutters.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A developing assembly for an image forming apparatus, comprising:

a developing unit including a case having an outer wall with a toner introduction port defined therein and a toner cartridge support formed thereon, a developing sleeve disposed within the case and exposed at one side of the case opposed to the toner introduction port, and a movable case shutter coupled to the case adjacent to the toner cartridge support and removably sealed over the toner introduction port; and a toner cartridge removably coupled to the developing unit at the toner cartridge support, including a toner box having an outer surface with a toner exhaust port defined therein and a box shutter with a concave portion facing the toner exhaust port and contacting the toner box, said box shutter being positionable to removably seal the toner exhaust port, wherein, when the toner cartridge is coupled to the toner cartridge support on the case of the developing unit, the case shutter and the box shutter are simultaneously positionable between open and closed positions to seal and unseal said toner introduction port and said toner exhaust port, respectively.

2. The developing assembly of claim 1 wherein the case of the developing unit defines a developing chamber having the developing sleeve disposed therein, and an agitation chamber with an agitation member therein, wherein the developing chamber and the agitation chamber are separated by a partition member, and the toner introduction port is formed in the outer wall of the case adjacent to the agitation chamber opposed from the partition member.

3. The developing assembly of claim 1 wherein the case shutter comprises an arcuate shutter wall with fan-shaped arms extending therefrom, the fan-shaped arms being pivotally coupled to the toner cartridge support so that the case shutter slides against the outer wall between the open position and closed position.

4. The developing assembly of claim 3 wherein the toner cartridge support comprises a pair of opposed brackets extending from the outer wall of the case, the brackets each including a shutter support formation rotatably coupled to the fan-shaped arms of the case shutter that pivotally couple the case shutter between the brackets to move selectively over the toner introduction port.

5. The developing assembly of claim 4 wherein the fan-shaped arms include a regulating member that engages at least one of the brackets to regulate pivotal range of the case shutter.

6. The developing assembly of claim 5 wherein the regulating member is an outwardly extending pin and at least one bracket has an arcuate guide groove in which the pin is slidably engaged.

7. The developing assembly of claim 3 wherein the toner cartridge support comprises a pair of opposed brackets extending from the outer wall of the case, the brackets each including a support groove formed therein, and the fan-shaped arms each includes an insertion groove that matches the support groove in the brackets, wherein the toner cartridge includes a support shaft having ends extending from opposed sides of the toner cartridge and an engagement projection, the ends of the support shaft being supported in the support grooves of the brackets and the insertion grooves of the case shutter, and wherein the engagement projection engages the insertion grooves of the fan-shaped arms.

8. The developing assembly of claim 7 wherein the brackets further include a slip-off prevention guide groove formed therein and being arcuate in shape and having an axis of curvature that coincides with a central axis of the support shaft of the toner cartridge, the slip-off prevention guide groove being in communication with the support grooves, wherein the engagement projection slides into the slip-off prevention guide groove when the case shutter and the box shutter are moved into the open position.

9. The developing assembly of claim 1 wherein the outer surface of the toner box is at least partially cylindrical and the box shutter is pivotally secured to the outer surface of the toner box, and wherein the box shutter comprises a pair of rotatable levers coupled to the box shutter.

10. The developing assembly of claim 9 wherein the toner cartridge further includes a support shaft, wherein the rotatable levers are secured to the support shaft and are integrally rotatable with respect to the support shaft.

11. The developing assembly of claim 10 wherein the support shaft engages the toner cartridge support of the developing unit.

12. The developing assembly of claim 10 further comprising at least one engagement projection extending from the rotatable levers that engages the case of the developing unit when the case shutter and the box shutter are in the open position and prevents the toner cartridge from being disassembled from the developing unit.

13. The developing assembly of claim 9 wherein the box shutter is releasably secured to the levers.

14. The developing assembly of claim 1 further comprising a case shutter lock comprising a releasable lock that locks the case shutter to the case when the case shutter is in the closed position covering the toner introduction port and releases when the case shutter is in the open position.

15. The developing assembly of claim 14 wherein the case shutter lock comprises a leaf spring secured to the outer wall of the case with an engagement claw extending outwardly therefrom, and a press pin secured to the toner cartridge, wherein the case shutter includes an engagement hole formed therein, wherein the engagement claw releasably engages the engagement hole when the case shutter is in the closed position and the press pin presses on the leaf spring and disengages the engagement claw when the toner cartridge is assembled onto the developing unit.

16. The developing assembly of claim 1 further comprising a box shutter lock including a releasable lock that locks the box shutter to the toner cartridge when the box shutter is in the closed position covering the toner exhaust port and releases when the box shutter is in the open position.

17. The developing assembly of claim 16 wherein the box shutter lock comprises a leaf spring secured to the outer wall of the toner box with an engagement claw extending outwardly therefrom, and a press pin secured to the case of the developing unit, wherein the box shutter includes an engagement hole formed therein and a notched groove formed therein, wherein the engagement claw releasably engages the engagement hole when the box shutter is in the closed position and the press pin slides into the notched groove to press on the leaf spring to disengage the engagement claw when the toner cartridge is assembled onto the developing unit.

18. The developing assembly of claim 16 further comprising a case shutter lock including a releasable lock that locks the case shutter to the case when the case shutter is in the closed position covering the toner introduction port and releases when the case shutter is in the open position, wherein when the toner cartridge is assembled onto the developing unit both the case shutter and the box shutter are unlocked.

19. The developing assembly of claim 1 wherein the case shutter is pivotal along the outer wall of the case, and the box shutter is pivotal along the outer surface of the toner box.

20. A developing unit in an image forming apparatus for attachment with a removable toner cartridge, comprising:

a case having an outer wall with a toner introduction port defined therein and a toner cartridge support formed thereon;

a developing sleeve disposed within the case and exposed at one side of the case opposed to the toner introduction port; and a movable case shutter having a convex portion facing the case and coupled to the case adjacent to the toner cartridge support and removably sealed over the toner introduction port and having an engaging formation that is engageable with a toner cartridge to interlock and move in unison with a shutter on the toner cartridge between open and closed positions, said case shutter being pivotable along an outer wall of the case, wherein when a toner cartridge is coupled to the toner cartridge support on the case, the case shutter moves between the open position in which the toner introduction port is open and the case shutter is disposed against the outer wall, and the closed position in which the toner introduction port is sealed by the case shutter.

21. The developing unit of claim 20 wherein the outer wall of the case adjacent to the toner introduction port is outwardly concave and the case shutter is convex and complementary to the outer wall.

22. The developing unit of claim 20 wherein the case shutter comprises an arcuate shutter wall with fan-shaped arms extending therefrom, the fan-shaped arms being pivotally coupled to the toner cartridge support so that the case shutter slides against the outer wall between the open position and closed position.

23. The developing unit of claim 22 wherein the toner cartridge support comprises a pair of opposed brackets extending from the outer wall of the case, the brackets each including a shutter support formation rotatably coupled to the fan-shaped arms of the case shutter that pivotally couple the case shutter between the brackets to move selectively over the toner introduction port.

24. The developing unit of claim 23 wherein the fan-shaped arms include a regulating member that engages at least one of the brackets to regulate a pivotal range of the case shutter.

25. The developing unit of claim 24 wherein the regulating member is an outwardly extending pin and at least one bracket has an arcuate guide groove in which the pin is slidably engaged.

26. The developing unit of claim 22 wherein the toner cartridge support comprises a pair of opposed brackets extending from the outer wall of the case, the brackets each including a support groove formed therein, and the fan-shaped arms each includes an insertion groove that matches the support groove in the brackets, wherein the insertion groove is the engaging formation.

27. The developing unit of claim 26 wherein the brackets further include a slip-off prevention guide groove formed therein arcuate in shape in communication with the support grooves that is engageable with a toner cartridge and prevents the toner cartridge from being disassembled when the case shutter is the open position.

28. The developing unit of claim 20 further comprising a case shutter lock comprising a releasable lock that locks the case shutter to the case when the case shutter is in the closed position covering the toner introduction port and releases when the case shutter is in the open position.

29. The developing assembly of claim 28 wherein the case shutter lock comprises a leaf spring secured to the outer wall of the case with an engagement claw extending outwardly therefrom, and the case shutter includes an engagement hole formed therein, wherein the engagement claw releasably engages the engagement hole when the case shutter is in the closed position, and when a toner cartridge is assembled onto the developing unit, the leaf spring is pressed to disengage the engagement claw.

30. A removable toner cartridge for attachment to an image forming apparatus, comprising:

a toner box having an outer surface with a toner exhaust port defined therein; and a movable box shutter with a concave portion facing the toner exhaust port and contacting the toner box, the movable box shutter being pivotally secured to the toner box to move between a closed position removably sealing the toner exhaust port and an open position disposed against the outer surface adjacent to the toner exhaust port, wherein the box shutter includes an engagement formation that engages and interlocks with a movable shutter on an image forming apparatus, the box shutter and the movable shutter being movable in unison between the open and closed positions when the toner cartridge is attached to an image forming apparatus.

31. The removable toner cartridge of claim 30 wherein the outer surface of the toner box is at least partially cylindrical and the box shutter is pivotally secured to the outer surface of the toner box.

32. The removable toner cartridge of claim 30 wherein the box shutter comprises a pair of rotatable levers coupled to the box shutter.

33. The removable toner cartridge of claim 32 wherein the box shutter is releasably secured to the levers.

34. The removable toner cartridge of claim 32 wherein the box shutter further comprises a pair of spaced ends that have a stop hold defined therein, and each of the levers includes a pair of spaced end guide grooves and a stop claw, the spaced ends of the box shutter being slidably engaged between the spaced end guide grooves and the stop claw engaging the stop hole.

35. The removable toner cartridge of claim 32 further comprising a box shutter lock including a releasable lock that locks the box shutter to the toner cartridge when the box shutter is in the closed position covering the toner exhaust port and releases when the box shutter is in the open position.

36. The removable toner cartridge of claim 35 wherein the box shutter lock comprises a leaf spring secured to the outer wall of the toner box with an engagement claw extending outwardly therefrom, and the box shutter includes an engagement hole formed therein and a notched groove formed therein, wherein the engagement claw releasably engages the engagement hole when the box shutter is in the closed position and the notched groove allows the leaf spring to be pressed to disengage the engagement claw when the toner cartridge is assembled onto an image forming apparatus.

37. The developing assembly of claim 1 wherein a gap is formed between the toner cartridge and the toner cartridge support on the case of the developing unit, and the case shutter and the box shutter become interlocked and movable between the open position in which the toner exhaust port and the toner introduction port are open and in communication and the case shutter and the box shutter are disposed within the gap, and the closed position in which the toner exhaust port and the toner introduction port are sealed by the box shutter and the case shutter, respectively, and wherein the toner cartridge is locked into the developing unit when the case shutter and the box shutter are in the open position and is removable from the developing unit when the case shutter and the box shutter are in the closed position.

38. The developing assembly of claim 1 wherein the toner cartridge is locked into the developing unit when the toner exhaust port and the toner introduction port communicate.

39. A developing assembly for an image forming apparatus, comprising:

a developing unit including a case having a toner introduction port defined therein and a toner cartridge support formed thereon, a developing sleeve disposed within the case and exposed at one side of the case opposed to the toner introduction port, and a movable case shutter coupled to the case adjacent the toner cartridge support and removably sealed over the toner introduction port; and a toner cartridge removably coupled to the developing unit at the toner cartridge support, including a toner box having a toner exhaust port defined therein and a box shutter with a concave portion facing the toner exhaust port and contacting the toner box, said box shutter being movable with respect to the toner cartridge for removably sealing the toner exhaust port, wherein the case shutter and the box shutter are movable between open and closed positions when the toner introduction port and the toner exhaust port are substantially aligned.

40. A toner cartridge removably coupleable to a developing unit, said developing unit including a case having an outer wall with a toner introduction port defined therein and a toner cartridge support formed thereon for supporting the toner cartridge, and a movable case shutter coupled to the case adjacent to the toner cartridge support and removably sealed over the toner introduction port, said toner cartridge comprising:

a toner box having an outer surface with a toner exhaust port defined therein; and a box shutter with a concave portion facing the toner exhaust port and contacting the toner box, said box shutter being removably sealable over the toner exhaust port, wherein, when the toner cartridge is coupled to the toner cartridge support on the case of the developing unit, the case shutter is displaceable to open and close the toner introduction port as the box shutter is positioned to open and close the toner exhaust port.

41. A developing assembly for an image forming apparatus, comprising:

a developing unit including a case having a toner introduction port defined therein and a toner cartridge support formed thereon, a developing sleeve disposed within the case and exposed at one side of the case opposed to the toner introduction port, and a case shutter movable along an arcuate path and being coupled to the case adjacent the toner cartridge support and removably sealed over the toner introduction port; and a toner cartridge removably coupled to the developing unit at the toner cartridge support, said toner cartridge including a toner box having a toner exhaust port defined therein and a box shutter having a concave portion facing the toner exhaust port and contacting the toner box, said box shutter being movable with respect to the toner box for removably sealing the toner exhaust port, wherein the box shutter is positionable between positions opening and closing said toner exhaust port as the case shutter moves along said arcuate path between corresponding positions opening and closing said toner introduction port.

* * * * *